US005549389A

United States Patent [19]

Takagaki et al.

[11] Patent Number: 5,549,389

[45] Date of Patent: Aug. 27, 1996

[54] OUTLET STOPPER FOR POUCH-TYPE FLUID CONTAINERS

[75] Inventors: Tadao Takagaki, Tokyo; Kisaku Chigusa, Osaka, both of Japan

[73] Assignee: Sumitomo Bakelite Company, Limited, Tokyo, Japan

[21] Appl. No.: 205,608

[22] Filed: Mar. 2, 1994

[30] Foreign Application Priority Data

Mar. 4, 1993 [JP] Japan ..... 5-069365

[51] Int. Cl.[6] ..... B65D 65/26

[52] U.S. Cl. ..... 383/202; 215/255; 220/265; 222/83.5; 383/80

[58] Field of Search ..... 215/217, 254, 215/255; 220/306, 265, 270; 222/83, 83.5; 383/202, 80

[56] References Cited

U.S. PATENT DOCUMENTS

| | | | |
|---|---|---|---|
| 1,509,137 | 9/1924 | Gottlieb | 383/80 |
| 3,817,416 | 6/1974 | Costa | 222/153 |
| 3,930,286 | 1/1976 | McGowen | 222/83 |
| 4,440,316 | 4/1984 | Christine | 222/83.5 |
| 4,456,150 | 6/1984 | Yang | 222/83 |
| 4,540,098 | 10/1985 | Luker | 215/254 |
| 4,583,665 | 4/1986 | Barriac | 222/83 |
| 4,830,273 | 5/1989 | Kalberer et al. | 220/359 |
| 4,887,912 | 12/1989 | Stumpf | 383/80 |
| 4,898,293 | 2/1990 | Morel | 215/250 |
| 5,016,757 | 5/1991 | Chatourel | 206/603 |
| 5,076,493 | 12/1991 | Anderson | 229/125.15 |
| 5,141,133 | 8/1992 | Ninomiya et al. | 222/83 |

FOREIGN PATENT DOCUMENTS

| | | | |
|---|---|---|---|
| 48604 | 4/1986 | France | 220/265 |
| 0348323 | 12/1989 | France . | |
| 2-127254 | 5/1990 | Japan . | |
| 2-108872 | 8/1990 | Japan . | |
| 49310 | 3/1993 | Japan | 383/202 |
| 246183 | 2/1964 | Netherlands | 220/265 |
| 1189439 | 4/1970 | United Kingdom | 222/83 |
| WO92/21581 | 12/1992 | WIPO . | |

*Primary Examiner*—Allan N. Shoap
*Assistant Examiner*—Robin A. Hylton
*Attorney, Agent, or Firm*—Frishauf, Holtz, Goodman, Langer & Chick

[57] ABSTRACT

An outlet stopper includes a cap part made of a resin and having a cylinder which has a screw thread on a side face thereof, and an outlet part made of a resin and having a disk flange which has a bottom face thereof coated with an adhesive. The disk flange has a hole at a center portion thereof. The outlet part has another cylinder which is placed on top of the disk flange and has a screw thread on a side face thereof which fits the screw thread on the cylinder in the cap part. An opening blade is fixed to the inside of the cap part, and a stopping ring which has a protrusion projected outward therefrom has a break therein for opening the ring and for stopping the insertion of the cap part and the outlet part into each other before reaching a fully screwed-in position. The outlet stopper can be easily attached with the adhesive to a package commercially available in a pouch form. By attaching the outlet stopper, packages made of soft plastic bags can be handled in the same manner as rigid packages having an outlet stopper, such as hard bottles. Thus, a major drawback of packages of a pouch form can be eliminated.

8 Claims, 5 Drawing Sheets

OUTLET STOPPER FOR POUCH-TYPE FLUID CONTAINERS

BACKGROUND OF THE INVENTION

1. Field of the Invention

The present invention relates to a novel outlet stopper which can be attached to a package made of a plastic bag used for containing commercial products.

2. Description of the Related Art

Commercial products which have heretofore been sold in bottles of glass or hard plastics, such as milk, soy sauce, oil, cosmetics and other like products in a fluid or slurry form, are now being sold in packages of paper cartons, bottles of thin plastic sheets and bags of plastic film (pouches).

An outlet stopper is attached to paper cartons and thin plastic bottles. A necessary amount of the content is taken out each time from the package through the outlet stopper and the remaining amount is kept in the package by closing the outlet stepper.

However, no outlet stopper is attached to plastic film bags of a pouch form. A pouch is opened by a consumer by tearing the film at a small cut made at an upper part of the pouch or by cutting an upper part of the pouch with scissors and then the contents are poured out from the package for use. When all the contents of the pouch are not used and some amount is left unused in the pouch, the opening has to be closed with a clip or the like. This causes inconvenience for the consumer.

To get rid of such inconvenience, pouches are provided with an outlet stopper. However, this practice has drawbacks in that a process of attaching a hard outlet stopper to a soft bag causes difficulty, that an outlet stepper attached to a bag causes problems in a process of packaging of commercial products by an automatic packaging machine; and that the outlet stopper causes problems in transportation and packing of bags because of its shape projected from the bag.

An outlet stopper for a packaging bag of a pouch form has been proposed recently in Japanese Patent Application Laid-Open No. 1990-127254 and Japanese Utility Model Application Laid-Open No. 1990 -108872. This outlet stopper has a structure comprising a cylinder having a flange and can be attached to the surface of a pouch at the bottom of the flange with a pressure-sensitive adhesive by a consumer who has purchased the pouch. Part of the film of the pouch exposed to the inner part of the flange is then cut to open the pouch. The cylinder is closed with a cap.

The difficulty during a production process of a pouch mentioned above and, the difficulty during an automatic packaging process and the inconvenience of packing of bags can be eliminated by using an outlet stopper which can be attached tea bag by a consumer. However, this-type of outlet stopper has a drawback that additional work, such as cutting a bag and constructing an outlet stopper, are required during the operation of attaching the outlet stopper by the consumer.

SUMMARY OF THE INVENTION

The present invention accordingly has an object to provide an outlet stopper which can be easily attached to a packaging bag of a pouch form.

The present invention provides an outlet stopper which can be attached at the bottom of a bag by a consumer and which opens the bag film and seals the bag with a cap stopper; the stopper operates simply by removing a stopping ring and closing the cap.

Thus, (1) the outlet stopper of the present invention comprises: a cap part made of a resin and having a cylinder which is closed with a roof at the top, and the cylinder has a screw thread on an inner side face thereof; an outlet part made of a resin and having a disk flange which is coated with an adhesive on a bottom face thereof and has a hole at a center thereof, and a cylinder which is placed on top of the disk flange and has on an outer side face thereof a screw thread which is screwable into the screw thread on the inner side face of the cylinder in the cap part; an opening blade made of a resin which is fixed downward at the center of the inner face of the roof of the cylinder in the cap part and has blade tips projected below the bottom face of the disk flange when the cap part is fully screwed into the outlet part; and a stopping ring which is wound round the outer face of the cylinder in the outlet part, is positioned between a lower end of the cap part and the top face of the disk flange in the outlet part and keeps the blade tips at a position that does not reach the bottom face of the disk flange in the outlet part by stopping insertion of the cap part into the outlet part before reaching the fully inserted position.

(2) The present invention also includes an outlet stopper as described in (1), wherein the stopping ring has a protrusion projected outward and a break to open the ring.

(3) The present invention also includes an outlet stopper as described in (1) or (2), wherein the stopping ring and the cylinder in the cap part are formed as a one-piece molded resin structure in which the stopping ring and the lower end of the cylinder are connected to each other through one or more connecting points.

(4) The outlet stopper of the present invention also comprises: a cap part made of a resin and having a cylinder which is closed with a roof at the top, the cylinder has a screw thread on the outer side face thereof and has a flange part projected outward at the edge of the upper end thereof; an outlet part made of a resin and comprising a disk flange which is coated with an adhesive on the bottom face thereof and has a hole at the center thereof, and a cylinder which is placed on top of the disk flange and has on the inner side face thereof a screw thread which is screwable into the screw thread on the outer side face of the cylinder in the cap part; an opening blade made of a resin which is fixed downward to the cap part and has blade tips projected below the bottom face of the disk flange when the cap part is fully screwed into the outlet part; and a stopping ring which is wound round the outer face of the cylinder in the cap part, is positioned between the upper end of the cylinder in the outlet part and the bottom face of the flange part in the cap part and keeps the blade tips at a position not reaching the bottom face of the disk flange in the outlet part by stopping insertion of the cap part into the outlet part before reaching the fully inserted position.

(5) The present invention also includes an outlet stopper as described in (4), wherein the stopping ring has a protrusion projected outward and a break to open the ring.

(6) The present invention also includes an outlet stopper as described in (4) or (5), wherein the stopping ring and the cylinder in the cap part are formed as a one-piece molded resin article in which the stopping ring and the lower end of the cylinder are connected to each other through one or more connecting points.

(7) The present invention also includes an outlet stopper as described in (4), (5) or (6), wherein the opening blade made of a resin is fixed at the lower end of the cylinder in the cap part.

Other and further objects, features and advantages of the invention will appear more fully from the following description.

BRIEF DESCRIPTION OF THE DRAWINGS

The invention will be described with reference to the accompanying drawings, wherein.

The numbers in the figures have the meanings as listed in the following:

| | |
|---|---|
| 1 | an outlet part |
| 11 | a flange |
| 12 | a cylinder in the outlet part |
| 13 | a screw thread |
| 14 | a hole |
| 15 | a pressure-sensitive adhesive |
| 16 | a release paper |
| 17 | an upper end of a cylinder |
| 2 | a cap part |
| 21 | a roof |
| 22 | a cylinder in the cap part |
| 23 | an opening blade |
| 24 | a screw thread |
| 25 | a circular rib |
| 26 | a circular ditch |
| 27 | a blade tip |
| 3 | a stopping ring |
| 30 | a connecting point |
| 31 | a protrusion |
| 32 | a break or gap in stopping ring 3 |
| 4 | a self-supporting bag |
| 41 | bottom space in a self-supporting bag |
| 40 | an outlet stopper of the present invention |

DETAILED DESCRIPTION OF THE INVENTION

The material used for the outlet stopper of the present invention is a resin. The resin is suitably selected to be a thermoplastic resin, such as polypropylene, high density polyethylene, low density polyethylene, linear low density polyethylene, high impact polystyrene, an ABS resin, polyvinyl chloride, a nylon, a polyester, a polycarbonate and the like, depending on a required moldability.

The present invention is described in more detail with reference to the following examples.

The outlet stopper in the first example of the present invention is composed of an outlet part 1, a cap part 2 having an opening blade and a stopping ring 3.

Figure 1:
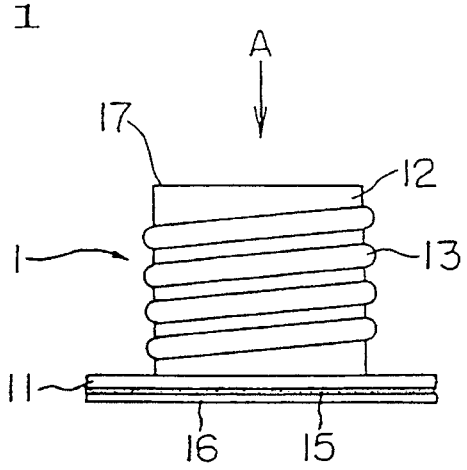
FIG. 1 is a side view of the outlet part in the first example of the present invention.
Figure 2:
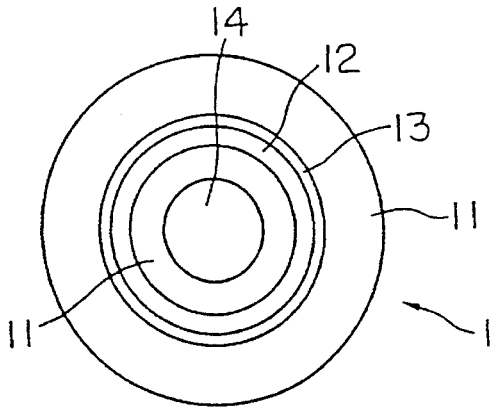
FIG. 2 is a plan view of the outlet part in the first example of the present invention.
Figure 3:
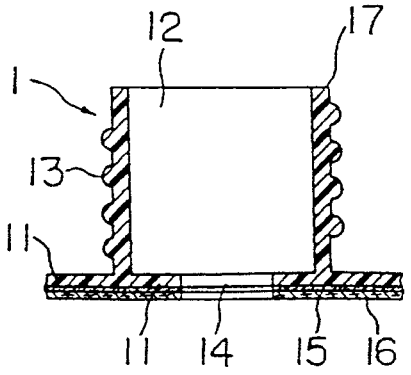
FIG. 3 is a side sectional view of the outlet part in the first example of the present invention.

FIG. 1 is a side view of the outlet part 1 of the present example. FIG. 2 is plan view of the same outlet part from the direction A shown in the side view. FIG. 3 is a side sectional view of the same outlet part.

As shown in the figures, the outlet part 1 is made of a resin and has a one-piece structure comprising a flange 11 and a cylinder 12. A release paper 16 has a hole at a center thereof to form a doughnut shape. The paper is coated with a pressure-sensitive adhesive 15 and is attached to the bottom face of the flange 11. When the release paper 16 is removed, the pressure-sensitive adhesive is transferred to the bottom face of the flange 11.

The flange 11 in the outlet part comprises a disk and has at its center a hole 14 which is the outlet for pouring out a fluid. A cylinder 12 is attached to the top face of the flange 11 perpendicularly. A screw thread 13 is formed on the outer side face of the cylinder 12.

Figure 4:
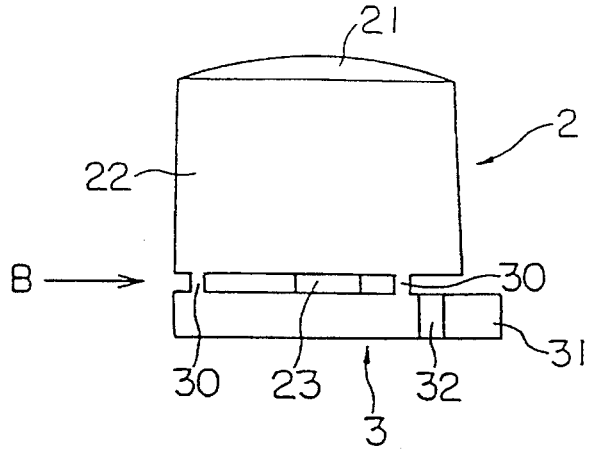
FIG. 4 is a side view of the cap part in the first example of the present invention.
Figure 5:
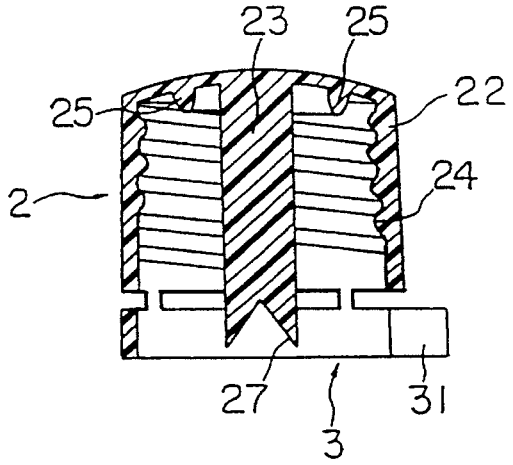
FIG. 5 is a side sectional view of the cap part and the stopping ring in the first example of the present invention.
Figure 6:
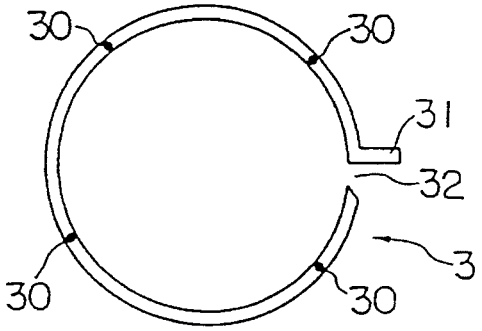
FIG. 6 is a plan view of the stopping ring in the first example of the present invention.

In FIGS. 4, 5 and 6, the cap part 2 of the outlet stopper in the present example and the stopping ring 3 are formed as a one-piece molded structure. FIG. 4 is a side view of the cap part 2. FIG. 5 is a side sectional view of the cap part 2. FIG. 6 is a plan sectional view of the cap part cut in a plane perpendicular to the face of paper sheet of the drawing. This figure substantially shows the plan view of the stopping ring 3 except for the positions of the connecting points 30.

Figure 8:
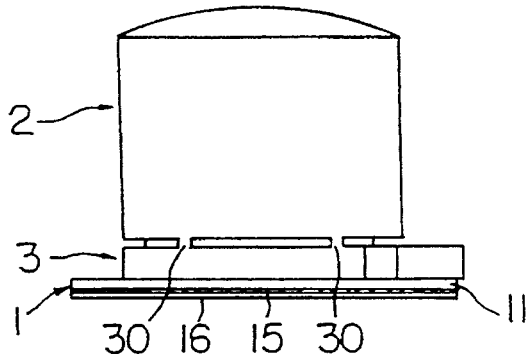
FIG. 8 is a side view of the outlet part and the cap part connected with the stopping ring which are fitted to each other in the first example of the present invention.
Figure 9:
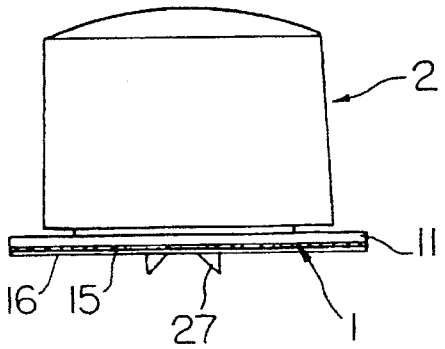
FIG. 9 is a side view of the outlet part and the cap part which are fitted to each other in the first example of the present invention.

FIGS. 8 and 9 are side views of the outlet part 1 and the cap part 2 fitted to each other. In FIG. 8, they are fitted to each other with a stopping ring 3 between them. In FIG. 9, they are fitted without a stopping ring 3.

The cap part 2 and the stopping ring 3 are connected to each other through four connecting points 30. The cap part 2 and the stopping ring 3 are molded simultaneously into a one-piece structure in which they are connected through the connecting points 30. It is necessary that the connecting point 30 has such a strength that the connecting point can be easily torn apart with hands. The width of the connecting point is varied depending on the type of the resin. The width is suitably selected to be in the range of 3 mm or less.

The cap part 2 of the present example comprises a roof 21, a cylinder 22 and an opening blade 23.

At the edge of the roof 21 in the cap part 2, the cylinder 22 is fixed in the direction perpendicular to the face of the roof. The roof 21 and the cylinder 22 together exhibit the function of the cap part 2 by covering the cylinder 12 of the outlet part 1.

On the inner side face of the cylinder 22, a screw thread 24 which exactly fits the screw thread on the outer side face of the cylinder 12 in the outlet part 1 is formed.

At the center of the roof 21, there is fixed an opening blade 23 which extends through the inside of the cap part 2 in the direction perpendicular to the face of the roof. In the present example, the opening blade 23 is molded together with the roof 21 in the cap part to form a one-piece structure. A separate opening blade may be fixed to the roof 21 by attaching and fitting them together to form a connected structure, such as that shown in Japanese Utility Model Application Laid-Open No. 1990-108872.

The opening blade 23 has a form made by cutting an end of a cylindrical stick to a shape having a side view of a wedge as shown in FIG. 5. The shape of the blade tip of the opening blade 23 is not particularly critical since any shape which can cut a bag film between the blade tip and the hole 14 can be adopted.

The diameter of the cylindrical stick of the opening blade 23 is approximately the same as the diameter of the hole 14 of the flange 11 in the outlet part 1. The blade tip 27 of the opening blade exactly fits the hole 14. Because of this condition, the blade tip 27 of the opening blade 23 works as a sharp blade tip and cuts the film of a packaging bag by pinching the film between the blade tip and the edge of the hole 14 of the flange 11 in the outlet part 1.

A length of the opening blade 23 is adjusted in such a manner that the blade tip 27 is projected from the bottom face of the flange 11 in the outlet part 1 as shown in FIG. 9 when the cap part 2 is put over the outlet part 1 and screwed into it until it is not movable any more.

Width of the stopping ring 3 in the direction of height is adjusted in such a manner that, when the stopping ring is placed between the outlet part 1 and the cap part 2, the blade tip of the opening blade 23 does not reach the bottom face of the flange 11 in the outlet part 1 to prevent cutting of the film as shown in FIG. 8.

On the bottom face of the roof 21 of the cap part 2, a circular rib 25 projected from the face of the roof 21 is formed in a concentric shape. When the cap part 2 is fitted into the outlet part 1 and fully screwed into it, a tapered face formed on the inner side of the upper end 17 of the cylinder 12 in the outlet part 1 tightly fits the tapered part at the outside of the rib 25. Thus, a perfect fluid tight condition is formed to prevent leaking of the fluid out of the outlet stopper.

In the cap part 2 of the present example, the fluid tight condition can be kept perfectly by the effect of the circular rib 25. Furthermore, because the diameter of the opening blade 23 is approximately the same as that of the hole 14 of the flange 11 in the outlet part 1, leakage of the fluid can be approximately prevented at the position of the hole 14 when the cap is put on. Therefore, the inside of the cap part 2 rarely gets wet with fluid of commercial products during ordinary operation of the stopper.

The stopping ring 3 of the present example has a structure of a ring with a break or gap 32 as shown in FIG. 6. It also has a protrusion 31 projected outward from the periphery of the ring.

The stopping ring 3 of the present example is molded to a one-piece structure together with the cylinder 22 of the cap part 2. Thus, the stopping ring 3 and the cylinder 22 in the cap part 2 form a ring sheet of a uniform thickness.

The ring is open at the break or gap 32 because the shape of the stopping ring is held by four connecting points 30 which connect the stopping ring 3 to the cap part 2.

Figure 7:
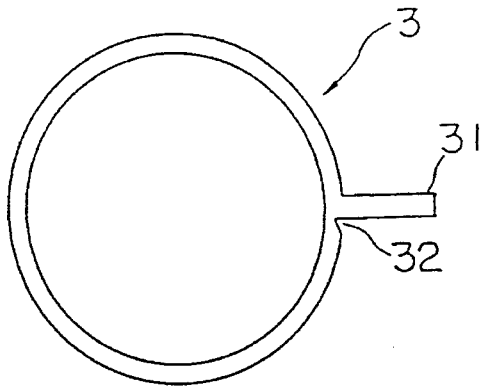
FIG. 7 is a plan view of the separate stopping ring used for another example of the present invention.

As another example of the present invention, a stopping ring 3 can be formed separate from the cap part 2. In this case, it is preferred that a break or indentation of a ditch shape 32 is formed at a position near the protrusion 31 as shown in FIG. 7.

When the protrusion 31 is pulled by fingers of a user, the stopping ring can be opened at the break 32 and removed.

The outlet stopper of the present invention is supplied in the form shown in FIG. 8. A consumer who purchased a bag containing a commercial product peels off the release paper 16 at first. The bottom face of the flange 11 is attached with a pressure-sensitive adhesive 15 to the surface of the film at a point P in the upper part of the self-supporting pouch bag shown in FIG. 14. Then, the stopping ring 3 is removed by pulling the protrusion 31. The adhesive 15 adheres the film around the hole in the center of the disk flange 11 to the pouch bag when a pressure is applied to the pressure-sensitive adhesive 15. The cap is then closed by screwing the cap part 2 into the outlet part until it cannot be inserted any more. When the cap is fully closed, the film of the bag is cut at the edge of the hole 14 of the flange 11. When the film is cut, all the film of the bag is not cut off but a part remains without being cut and is left attached to the edge of the hole 14. Thus, mixing of the cut piece of the film into the contents of the bag is prevented.

Then, the cap part 2 is taken off from the outlet part 1 by unscrewing the cap part and the fluid contained in the bag can be poured out in a small amount. When the cap part is fully screwed into the outlet part again after pouring out the contents, the bag can be sealed in a fluid tight condition with the circular rib 25 and the edge 17 at the upper end of the outlet part 1.

Because sealing of the outlet stopper of the present invention perfectly prevents leakage of the fluid with the rib 25 and the upper end of the outlet part 1, the outlet stopper can be attached to a part of a packaging bag below the level of the contained fluid. When the cap part 2 is screwed into the outlet part 1, the fluid tight condition of the outlet stopper 1 is formed at the moment that the bag is cut with the blade tip 27. Thus, leakage of a fluid from the outlet stopper is prevented.

As another form of the present example, a stopping ring 3 may be separate from the cap part 2 as described above. The stopping ring 3 may be molded into a one-piece structure with the outlet part 1, as well.

When the separate stopping ring is adopted in the present invention, a stopping ring of a simple shape as shown in FIG. 6 and has at least one of a protrusion 31 and a gap or break 32. In this case, the outlet stopper is opened by taking off the cap part from the outlet part and removing the stopping ring which prevents the cap part from being fully screwed into the outlet part, followed by putting on the cap part again and screwing it fully into the outlet part.

The present invention is further described with reference to the second example in the following.

The second example of the outlet stopper of the present invention comprises an outlet part 1, a cap part 2 and an independently separated stopping ring 3. This example is different from the first example in that a cylinder of the cap part 2 is fitted into the inside of the outlet part 1.

Figure 10:
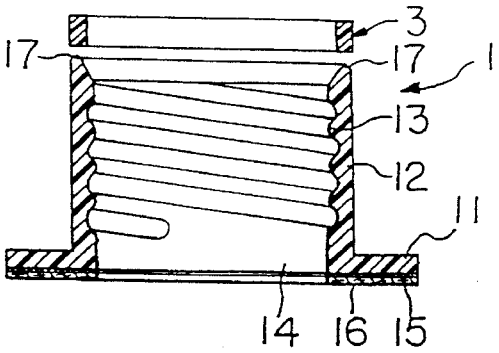
FIG. 10 is a side sectional view of the outlet part of the second example of the present invention.
Figure 11:
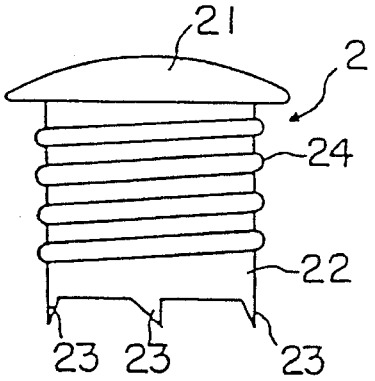
FIG. 11 is a side view of the cap part in the second example of the present invention.
Figure 12:
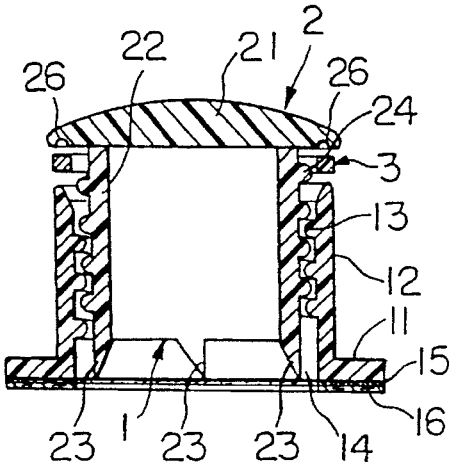
FIG. 12 is a side sectional view of the outlet part and the cap part which are separated by the stopping ring and fitted to each other in the second example of the present invention.

FIG. 10 is a side sectional view of the outlet part 1 of the present example. FIG. 11 is a side view of the cap part 2 which is fitted into the outlet part 1. FIG. 12 is a sectional view showing the outlet part 1 and the cap part 2 fitted to each other.

The outlet part 1 is composed of a flange 11 and a cylinder 12. A screw thread 13 is formed on the inner face of the cylinder 12.

At the center of the flange 11, a hole 14 having a diameter approximately the same as the inner diameter of the cylinder is formed. A pressure-sensitive adhesive 15 and a release paper 16 are attached to the bottom face of the flange 11.

The second example has a characteristic that plural opening blades 23 are formed at the end of the cylinder 22 in the cap part 2 and a hole 14 having a diameter approximately the same as that of this cylinder is opened. Thus, this example has an advantage that an outlet of a larger diameter can be formed while a size of the outlet stopper is kept the same.

The edge at the upper end 17 of the cylinder 12 in the outlet part 1 is inclined with a taper as shown in the sectional view of FIG. 10.

FIG. 11 is a side view of the cap part of the present example.

To the roof 21, a cylinder 22 having an outer diameter smaller than the diameter of the roof is attached in the perpendicular direction. An opening blade 23 comprising 4 blade tips arranged on the edge at equal distances is formed at the lower end of the cylinder.

In the second example, because the blade tips of the opening blade 23 are formed at the end of the cylinder, the opening blade 23 fits exactly the hole 14 and an allowance between the diameter of the opening blade 23 and the diameter of the hole 14 is not required.

A screw thread 24 which fits the screw thread on the inner face of the outlet part 1 is formed on the outer face of the cylinder 22. A periphery of the roof 21 is extended from the upper end 17 of the cylinder in the outlet part 1. A circular ditch 26 having a section shown in FIG. 12 is formed at a position where the roof meets the upper end 17 of the outlet part 1.

The separate stopping ring shown in FIG. 7 may be used as the stopping ring 3 in the present example, as well.

FIG. 12 is a side sectional view of the stopping ring 3 shown in FIG. 7 placed on top of the outlet part 1 and fitted to the cap part 2.

As this side sectional view of the outlet stopper of the present example shows, when the cap part 2 is fitted into the outlet part 1 with use of the stopping ring 3 between them, the blade tips of the opening blade 23 is fitted into the hole 14 of the flange 11 and stops immediately before reaching the bottom face.

After the outlet stopper is attached to the surface of a packaging bag with the adhesive 15 at the bottom face of the outlet part 1, the stopping ring 3 is removed by pulling the protrusion 31. When the cap part 2 is screwed into the outlet part 1, the opening blade 23 rotates and cuts the bag film by pinching it between the edge of the hole 14 of the flange 11 and the blade. The stopping ring 3 is placed near the roof 21 of the outlet stopper and the protrusion 31 can be easily picked up with fingers of the user.

When the cap part is closed after opening the bag and pouring out a small amount of the fluid content, the upper end 17 having a tapered edge in the outlet part 1 fits the circular ditch 26 on the cap part 2 and the bag is tightly sealed in the fluid tight condition by the cap part 2. Like the case in the first example, the contents of the bag are sealed to some degree by the edge of the hole 14, the side face around the opening blade 23 and the sealing structure by the circular ditch 26 and thus the upper end 17 may be omitted in some cases.

Figure 13:
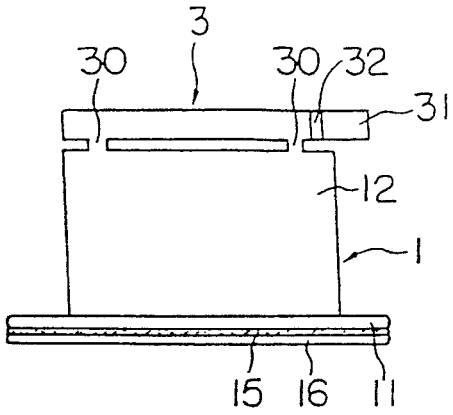
FIG. 13 is a side view of the cap part and the stopping ring having a one-piece structure and used in another example.

In the present example, the stopping ring 3 and the outlet part 1 may be formed into a one-piece structure as shown in FIG. 13. When this structure is adopted, the stopping ring 3 connected to the outlet part with connecting points 30 in the same manner as that shown in FIG. 4 can be pulled out with the protrusion 31 and removed. In the second example, it is convenient for production that the stopping ring 3 and the outlet part 1 are formed into a one-piece structure.

The outlet stopper of the present invention can be applied to packaging bags of conventional plastic bags without any restriction. It is particularly conveniently applied to packaging bags having self-supporting property because the bags can be handled in a same manner as conventional hard bottles having an outlet stopper.

Figure 14:
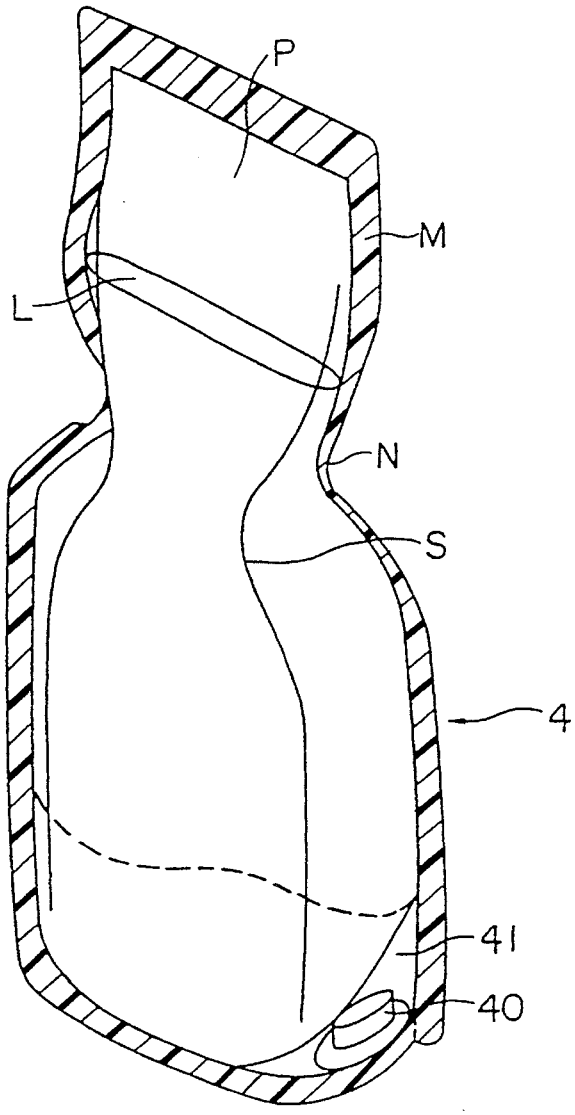
FIG. 14 is a perspective view showing a self-supporting bag and the outlet stopper of the present invention attached to the bag.

Particularly, in self-supporting bags, such as those disclosed in PCT Application WO92/21581 (internationally laid-open on Dec. 10, 1992), wherein the self-supporting property is exhibited because of the structure of the bottom part of the bag and the property is improved further by a constriction formed at the upper part of the bag and also by linear ribs formed on the surface of the bag so that the upper part of the bag is provided with the self-supporting property as well as the bottom part. The packaging bag shown in FIG. 14 is a self-supporting bag containing a fluid commercial product. The bag of FIG. 14 has two sealed side edges and a bottom of a conventional steric structure with a gazette folding to provide the bag with the self-supporting property. The bag has a constriction N at the middle of the bag and curved ribs S on the surface of the bag to achieve a total self-supporting property even when the upper part of the bag contains a fluid to the fluid level L.

When the outlet stopper of the present invention is attached to a position P at the upper part of the bag, the packaging bag remains self-supported even when the bag is almost empty. Thus, the bag can be conveniently stored by standing on a shelf in a similar manner to glass bottles and plastic bottles containing foods, detergents and the like and can be handled in the similar manner to glass bottles and plastic bottles. For example, a large number of the bags can be stored by standing side by side on a narrow shelf area or a bag with an open stopper can be gripped with a single hand and inclined to pour out a fluid contained in the bag in a similar manner to a bottle.

The outlet stopper of the present invention is favorably used in combination with a self-supporting bag. It is convenient for use by a consumer and also for packing and transportation, since the outlet stopper is contained in a hollow space 41 of FIG. 14 in the bottom structure of a self-supporting bag 4 having a self-supporting bottom structure with a gazette folding by laying there or attaching it to the bag with a pressure-sensitive adhesive material or a pressure-sensitive adhesive tape.

To summarize the advantages obtained by the invention, by using the outlet stopper of the present invention, an outlet stopper can be easily attached by a consumer to a packaging bag commercially available in a pouch form. After a small amount of the content is taken out, the content can be kept in the bag for later use in small amounts.

Packages made of soft plastic bags can be handled in the same manner as packages having an outlet stopper, such as hard bottles. Thus, the major drawback of packages of a pouch form can be eliminated.

Particularly, a stopping ring can be removed by simply pulling a protrusion with a user's fingers. A consumer can easily attach an outlet stopper which can be opened and closed at will to a packaging bag of a pouch form.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An outlet stopper for providing an outlet opening at any position on a soft-sided pouch-type container, comprising:

a cap part made of a resin and having a cap part cylinder which is closed with a roof fixed to the cap part cylinder at a top portion of the cap part cylinder, the cap part cylinder having a cap part screw thread on an inner side face thereof;

an outlet part made of a resin and having a disk flange which is coated with an adhesive on a bottom face thereof, said disk flange having a hole at a center portion thereof, said outlet part having an outlet part cylinder on top of said disk flange, said outlet part cylinder having on an outer side face thereof an outlet part screw thread, the cap part screw thread on the inner side face of the cap part cylinder being screwable onto the outlet part screw thread;

opening blade means made of a resin and which is fixed to the roof of the cap part so as to project in a downward direction at a center portion of an inner face of the roof of the cap part, said opening blade means having blade tips that are projected below a bottom face of the disk flange when the cap part is in a fully screwed-in position on the outlet part, said opening blade means being rotatable with the cap part when the cap part is screwed onto the outlet part, for opening a pouch-like container when the adhesive on the disk flange is adhered to the pouch-like container and when said cap part is rotated to the fully screwed-in position on said outlet part; and a stopping ring which is wound around an outer face of the outlet part cylinder of the outlet part, said stopping ring being positioned between a lower end of the cap part and a top face of the disk flange, said stopping ring spacing the blade tips apart from the bottom face of the disk flange by stopping an insertion of the cap part onto the outlet part before the cap part reaches the fully screwed-in position, and wherein:

the stopping ring comprises a protrusion that is projected in an outward direction from the stopping ring, the stopping ring further having a gap therein for enabling removing of the stopping ring from the outlet part cylinder to permit the cap part to reach the fully screwed-in position on the outlet part to thereby open the pouch-like container; and the stopping ring and the cap part cylinder are integrally molded so as to form a one piece molded resin structure, and the stopping ring and a lower end portion of the cap part cylinder are connected to each other by at least one connecting point which is breakable for removal of the stopping ring.

2. The outlet stopper according to claim 1, wherein when said disk flange is attached to a pouch-like container by use of the adhesive thereon, the adhesive holds a film portion of the pouch-like container around the hole in the center of said disk flange to said disk flange, said opening blade moves into said hole in said disk flange and cuts the film portion of the pouch-like container as the cap part and the outlet part are moved to the fully screwed-in position after removal of said stopping ring.

3. The outlet stopper according to claim 1, wherein the outlet stopper is positioned at a non-sealed position of the pouch-type container.

4. An outlet stopper for opening a soft-sided pouch-type container at any position of the container, comprising:

a cap part made of a resin and having a cap part cylinder which is closed with a roof fixed to the cap part cylinder, the cap part cylinder having a cap part screw thread on an outer side face thereof;

an outlet part made of a resin and having a disk flange which is coated with an adhesive on a bottom face thereof, said disk flange having a hole at a center portion thereof, said outlet part having an outlet part cylinder on top of said disk flange, said outlet part cylinder having on an inside side face thereof an outlet part screw thread, the cap part screw thread on the outer side face of the cap part cylinder being screwable into the outlet part screw thread;

opening blade means made of a resin and which is fixed to the roof of the cap part so as to project in a downward direction at a center portion of an inner face of the roof of the cap part, said opening blade means having blade tips that are projected below a bottom face of the disk flange when the cap part is in a fully screwed-in position in the outlet part, said opening blade means being rotatable with the cap part when the cap part is screwed onto the outlet part, for opening a pouch-like container when the adhesive on said disk flange is adhered to the pouch-like container and when said cap part is rotated to the fully screwed-in position in the outlet part; and a stopping ring which is wound around an outer face of the outlet part cylinder of the outlet part, said stopping ring being positioned between the cap part and a top face of the disk flange, said stopping ring spacing the blade tips apart from the bottom face of the disk flange by stopping an insertion of the cap part in the outlet part before the cap part reaches the fully screwed-in position, and wherein:

the stopping ring comprises a protrusion that is projected in an outward direction from the stopping ring, the stopping ring further having a gap therein for enabling removing of the stopping ring from the outlet part cylinder to permit the cap part to reach the fully screwed-in position on the outlet part to thereby open the pouch-like container; and the stopping ring and the cap part cylinder are integrally molded so as to form a one piece molded resin structure, and the stopping ring and the cap part cylinder are connected to each other by at least one connecting point which is breakable for removal of the stopping ring.

5. The outlet stopper according to claim 4, wherein said roof is at a top portion of said cap part.

6. The outlet stopper according to claim 4, wherein the outlet stopper is positioned at a non-sealed position of the pouch-type container.

7. An outlet stopper as claimed in claim 4, wherein said opening blade is made of a resin and is fixed at a lower end portion of the cap part cylinder.

8. The outlet stopper according to claim 4, wherein when said disk flange is attached to a pouch-like container by use of the adhesive thereon, the adhesive holds a film portion of the pouch-like container around the hole in the center of said disk-flange to said disk flange, said opening blade moves into said hole in said disk flange and cuts the film portion of the pouch-like container as the cap part and the outlet part are moved to the fully screwed-in position.

* * * * *